United States Patent [19]

Matsuoka

[11] 4,401,606

[45] Aug. 30, 1983

[54] APPARATUS AND METHOD FOR REFORMING HIGH-MOLECULAR WEIGHT OILS

[75] Inventor: Mitsutoshi Matsuoka, Tottori, Japan

[73] Assignee: Takeshi Arakawa, Fukuoka, Japan; a part interest

[21] Appl. No.: 299,954

[22] Filed: Sep. 8, 1981

[30] Foreign Application Priority Data

Sep. 11, 1980 [JP] Japan ..... 55-127637
Oct. 30, 1980 [JP] Japan ..... 55-153516

[51] Int. Cl.[3] ..... B01F 3/04
[52] U.S. Cl. ..... 261/93; 366/102; 366/310; 366/325
[58] Field of Search ..... 366/325, 326, 327, 329, 366/279, 309, 310, 312, 101, 102, 107; 261/93

[56] References Cited

U.S. PATENT DOCUMENTS

| | | | |
|---|---|---|---|
| 328,134 | 10/1885 | McKay | 366/326 |
| 3,049,750 | 8/1962 | Austin | 366/327 |
| 3,232,709 | 2/1966 | Cole | 366/325 |
| 4,123,226 | 10/1978 | Vanderveen | 366/325 |

FOREIGN PATENT DOCUMENTS

| | | | |
|---|---|---|---|
| 635711 | 9/1936 | Fed. Rep. of Germany | 366/310 |

*Primary Examiner*—Robert W. Jenkins
*Attorney, Agent, or Firm*—Allison C. Collard; Thomas M. Galgano

[57] ABSTRACT

An apparatus for preparing dispersions comprising a closed casing in the form of a bottomed hollow cylinder, a rotor disposed within the casing coaxially therewith and having a multiplicity of hard wire projections on the peripheral wall of the rotor, at least one liquid inlet pipe connected to one end of the casing, a dispersion outlet pipe connected to the other end of the casing and drive means disposed outside the casing at one side thereof for rotating the rotor at a high speed.

4 Claims, 4 Drawing Figures

APPARATUS AND METHOD FOR REFORMING HIGH-MOLECULAR WEIGHT OILS

BACKGROUND OF THE INVENTION

This invention relates to an apparatus for preparing dispersions such as emulsions and suspensions, and more particularly to an apparatus for preparing dispersions of fuel oils and the like which burn efficiently.

Apparatus for preparing such dispersions are known in which a liquid is dispersed with use of ultrasonic waves or by rotating a bladed wheel or the like. Although known device are capable of preparing milky dispersions having ultrafine droplets or particles dispersed therein with stability, they have the problem of affording dispersions only in small quantities. Further if it is attempted to produce dispersions in increased quantities, the resulting dispersion contains larger particles dispersed therein. This entails another problem in that in the case of fuel oil, for example, the dispersion has a low combustion efficiency.

SUMMARY OF THE INVENTION

The present invention, which has overcome the above problems, provides an apparatus comprising a closed casing and a rotor disposed within the casing and having a multiplicity of hard wire projections on the peripheral wall of the rotor. When the hard wire projections are rotated with the rotor at a high speed with a liquid placed in the casing, the liquid is very finely divided into minute particles, so that a stable dispersion can be prepared continuously in a large quantity. When heavy oil or like fuel oil is used as the liquid, the dispersion has a greatly increased combustion efficiency. The apparatus of this invention has the advantages of having a simple construction, being easy and inexpensive to make, requiring only a small space for installation because of its compactness and being easy to operate without necessitating any special skill.

The invention will be described below in greater detail with reference to the accompanying drawings.

DESCRIPTION OF THE PREFERRED EMBODIMENTS

Figure 1:
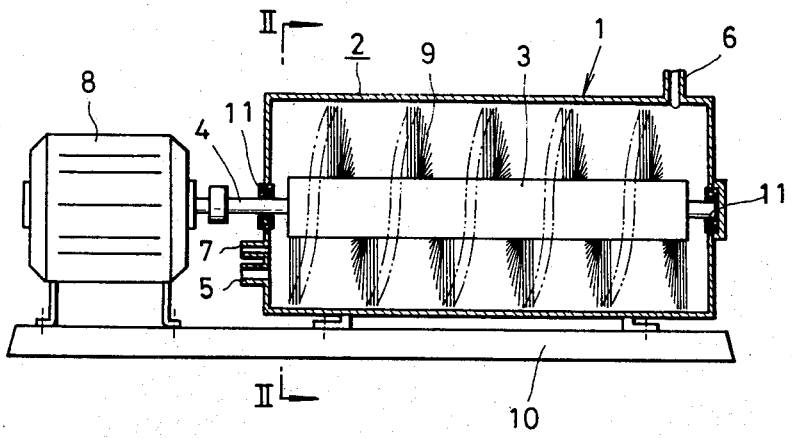
FIG. 1 is a view partly in vertical section showing an apparatus of this invention for preparing dispersions.
Figure 2:
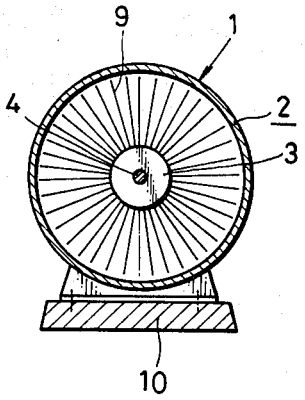
FIG. 2 is a view in section taken along the line II—II in FIG. 1.

With reference to FIGS. 1 and 2, a dispersing apparatus 1 according to the invention includes a closed casing 2 in the form of a hollow cylinder closed at the bottom and supported horizontally on a base 10. The casing 2 has accommodated therein a rotor 3 having a multiplicity of hard wire projections 9 made of steel and arranged helically on the peripheral wall of the rotor. The rotor 3 has a rotary shaft 4 positioned in the center of the casing and supported at its opposite ends by bearings 11 on opposite side walls of the casing 2. For example, the casing 2 is 150 mm in diameter, the rotor 3 is 80 mm in diameter, and the steel wire projections 9 are 0.8 mm in diameter and 33 mm in length. There is a clearance of 2 mm between the casing 2 and the projections 9. A dispersing medium inlet pipe 5 and a dispersible material inlet pipe 7 are attached to one side wall of the casing 2, while a dispersion outlet pipe 6 is connected to the other side wall thereof. Examples of useful dispersing media include fuel oils, such as heavy oil, kerosene and gas oil, animal and vegetable oils, waste oils, etc. Examples of useful dispersible materials are water, etc. Outside the casing 2 a motor 8 is mounted on the base 10 and has a drive shaft connected to the rotary shaft 4.

Heavy oil as an example of dispersing medium is introduced into the casing 2 through the inlet pipe 5, and a dispersible material, for example water, is placed into the casing 2 through the inlet 7 in a proportion of 10 to 30% based on the heavy oil. When the rotor 3 having the multiplicity of steel projections 9 is driven within the casing 2 at a speed of 1600 to 3600 r.p.m., the steel wire projections 9, which are mde slender to reduce the resistance to be encountered in liquids, move at a speed of 20 to 50 m/sec, forming a high-speed shearing face and causing cavitation in the liquid in the vicinity of the rear side of the assembly of the projections with respect to the direction of the movement. Consequently the water is dispersed in the form of ultra-fine particles of the order of microns, and the heavy oil is divided into fine particles or droplets and also into smaller molecules, whereby a stable milky dispersion is prepared. The dispersion is progressively sent toward the outlet side of the casing 2 by the rotation of the steel wire projections 9 which are arranged as a helical assembly and is discharged from the casing 2 through the outlet pipe 6.

The dispersion thus obtained is a milky fuel oil in which the heavy oil is given an increased combustion efficiency by the ultrafine water particles having an explosive force. This results in 1 to 3% savings in heavy oil for the economical use of energy and also achieves a 20 to 70% reduction of pollutants, such as soot, dust and nitrogen oxides, contained in the exhaust gas.

Although the above embodiment has been described as used for preparing a milky dispersion of fuel oil from heavy oil as the dispersing medium and water as the dispersed material, a fuel oil dispersion can be prepared similarly, for example, from 70% of heavy oil and 30% of unrefined waste oil. The waste oil is then reusable for savings in energy. The diameter of the casing 2 is 100 to 250 mm, preferably 150 to 200 mm. The hard wire projections 9 are 0.5 to 1.2 mm, preferably 0.5 to 1 mm, in diameter and 20 to 35 mm, preferably 27 to 33 mm, in length. The forward ends of the hard wire projections are spaced from the inner peripheral wall surface of the casing by a clearance of 1 to 5 mm, preferably of 1 to 3 mm.

Figure 3:
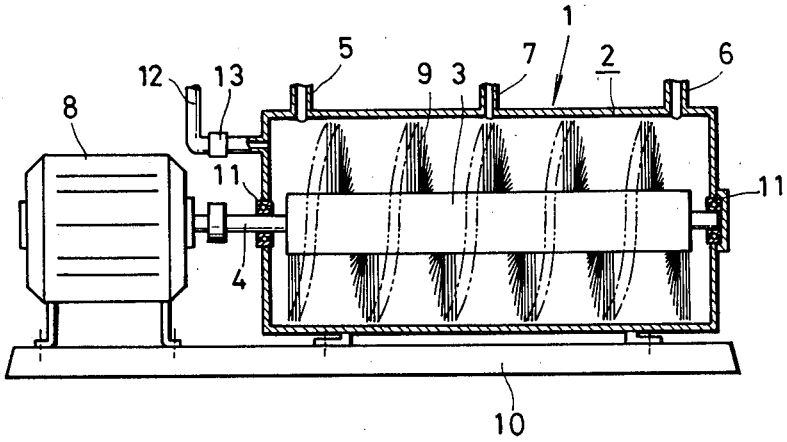
FIGS. 3 and 4 are views partly in vertical section and each showing another embodiment of the invention.

FIG. 3 shows another dispersion preparing apparatus embodying the invention. According to this embodiment, the casing 2 of the first embodiment has an air inlet pipe 12 connected to one side wall thereof and equipped with a check valve 13. An inlet pipe 5 for heavy oil or like dispersing medium is connected to one end portion of the peripheral wall of the casing 2. An inlet pipe 7 for water or like dispersible material is connected to a midportion of the peripheral wall. An oxygen-containing gas, such as air, is fed to the casing 2 in an amount of 1 to 5 vol. % based on the liquid in the casing 2, whereby the load on the motor 8 is greatly mitigated. For example, when a motor 8 of 3.7 KW is used with 1 to 5 vol.% of air fed to the casing based on the oil, the current needed is about 18 A, whereas in the absence of air, the current used is 22 to 30 A, hence a great reduction in the load.

Figure 4:
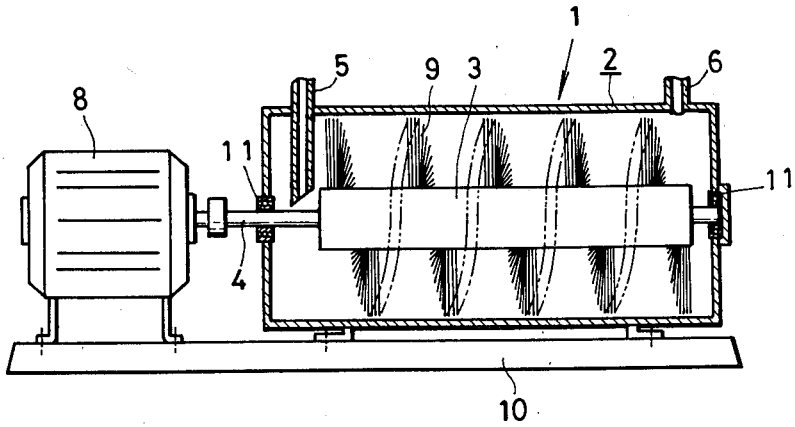

FIG. 4 shows another dispersion preparing apparatus embodying the invention, in which the same casing 2 as shown in FIGS. 1 and 2 has a heavy oil or like liquid inlet pipe 5 extending through one end portion of the peripheral wall of the casing but is not adapted to receive a supply of different liquid such as water. This embodiment is used for reforming fuel oils, such as heavy oil, waste oil, animal and vegetable oils, etc., which have a relatively large molecular weight.

When the rotor 3 having hard wire projections 9 is rotated at a high speed with heavy oil or like fuel oil introduced into the casing 2 through the liquid inlet pipe 5, the projections 9 move in the oil at a speed of 20 to 50 m/sec, so that a large cavitation occurs in the oil in the vicinity of the rear side of the assembly of the projections 9 with respect to the direction of the movement. The resulting high pressure and heat break down the components of the fuel oil into smaller molecules and ultrafine particles and disperse the particles while elevating the temperature of the oil by 20°–40° C. Consequently the fuel oil becomes less viscous and more amenable to pulverization, for example, in the combustion chamber of a boiler and to mixing with air and is thereby rendered ignitable and combustible efficiently.

For example, when heavy oil (boiler fuel) was agitated at a high speed with the apparatus of this invention and then fed to the combustion chamber of a boiler, the fuel burnt efficiently, achieved an increase of 6.1% in boiler efficiency and resulted in 7.1% reduction in fuel oil consumption. Thus the heavy oil given enhanced ability to burn burns completely almost without producing carbon monoxide and with reduced nitrogen oxide emissions for the prevention of pollution.

Because of the improved combustion efficiency, the fuel oil treated by the present apparatus is usable without necessitating a preheater which otherwise would be needed.

The present invention may be embodied differently without departing from the spirit and basic features of the invention. Accordingly the embodiments herein disclosed are given for illustrative purposes only and are in no way limitative. It is to be understood that the scope of the invention is defined by the appended claims rather than by the specification and that various alterations and modifications within the definition and scope of the claims are included in the claims.

What is claimed is:

1. A method for reforming high molecular weight fuel oils, comprising the steps of introducing a high molecular weight fuel oil selected from the group consisting of heavy oil, waste oil, animal oil and vegetable oil, and water in a proportion of 10 to 30 vol. % based on the fuel oil into a casing, and dispersing the water in the fuel oil in the form of ultrafine particles by rotating a rotor having a number of hard wire projections at a speed of 1600 to 3600 r.p.m. in the casing.

2. A method as defined in claim 1, further comprising the steps of introducing a gas selected from the group consisting of air and an oxygen-containing gas into the casing in an amount of 1 to 5 vol. % based on the fuel oil.

3. An apparatus for reforming high molecular weight fuel oils comprising a closed casing defining a central axis, and having the form of a hollow cylinder having a diameter of 100 to 250 mm, a first inlet pipe communicating with said casing for introducing thereinto a high molecular weight fuel oil selected from the group consisting of heavy oil, waste oil, animal oil and vegetable oil, said fuel oil being reformed in said casing, a second inlet pipe communicating with said casing for introducing water at one end of said casing, an outlet pipe communicating with said casing for discharging the reformed fuel oil at the other end of said casing, a rotor disposed coaxially within said casing and provided with a multiplicity of slender hard wire projections having a diameter of 0.5 to 1.2 mm, a length of 20 to 35 mm, and arranged as a helical assembly, a clearance ranging from 1 mm to 5 mm existing between an inner peripheral wall surface of said casing and outward ends of said projections, and drive means for rotating said rotor at a high speed disposed outside said casing at one side thereof.

4. An apparatus as defined in claim 3, wherein the casing has a diameter of 150 to 200 mm, the hard wire projections have a diameter of 0.5 to 1.0 mm and a length of 27 to 33 mm, the clearance between the inner peripheral wall of the casing and the forward ends of the projections being 1 to 3 mm, the projections being operatively rotated at a speed of 20 to 50 m/sec. in the mixture of the fuel oil and of the water.

* * * * *